US007474863B2

(12) United States Patent
Kaiga

(10) Patent No.: US 7,474,863 B2
(45) Date of Patent: Jan. 6, 2009

(54) ELECTROPHOTOGRAPHIC IMAGE FORMING APPARATUS HAVING MAIN ASSEMBLY CONTACT CONTACTING A CARTRIDGE CONTACT OF A MEMORY

(75) Inventor: Miho Kaiga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/552,336

(22) Filed: Oct. 24, 2006

(65) Prior Publication Data

US 2007/0098437 A1 May 3, 2007

(30) Foreign Application Priority Data

Oct. 28, 2005 (JP) ..... 2005-314792

(51) Int. Cl.
*G03G 15/00* (2006.01)
*G03G 21/16* (2006.01)

(52) U.S. Cl. ..... 399/90; 399/111

(58) Field of Classification Search ..... 399/90, 399/107, 110, 111
See application file for complete search history.

(56) References Cited

U.S. PATENT DOCUMENTS 6,826,380 B2 * 11/2004 Karakama et al. ..... 399/111
6,876,826 B2 4/2005 Noda et al. ..... 399/90
6,922,534 B2 * 7/2005 Goto et al. ..... 399/90 X
7,194,220 B2 3/2007 Sasaki et al. ..... 399/90
2003/0215257 A1 * 11/2003 Karakama et al. ..... 399/90
2005/0201773 A1 * 9/2005 Matsubara et al. ..... 399/90

* cited by examiner

*Primary Examiner*—Sandra L Brase
(74) *Attorney, Agent, or Firm*—Fitzpatrick, Cella, Harper & Scinto

(57) ABSTRACT

An electrophotographic image forming apparatus forms an image on a photosensitive drum of a process cartridge also containing, process means, and a memory with a contact. The apparatus includes a member movable between opening and closing positions; a detector detecting closing of the movable member; a connector having a contact s movable between contact and separating positions; (v) an operator moving the connector from the separating to the contact position; a holder engageable with the operator to hold the connector at the contact position; for a controller communicating with the memory through the connector after detection of a signal change outputted from the detector when the movable member moves away from the closing position; for a releasor releasing engagement between the holding and operation members after the movable member moves from the closing position by a predetermined distance; and an urger urging the connector in a direction away from the contact position toward the separating position.

6 Claims, 14 Drawing Sheets

ELECTROPHOTOGRAPHIC IMAGE FORMING APPARATUS HAVING MAIN ASSEMBLY CONTACT CONTACTING A CARTRIDGE CONTACT OF A MEMORY

FIELD OF THE INVENTION AND RELATED ART

The present invention relates to an electrophotographic image forming apparatus in which a process cartridge is removably mountable.

Here, the term "electrophotographic image forming apparatus" means an image forming apparatus which uses an electrophotographic image forming method to form an image on a recording medium. As examples of an electrophotographic image forming apparatus, an electrophotographic copying machine, an electrophotographic printer (for example, laser printer, LED printer, etc.) a facsimile machine, a word processor, a multifunction printer capable of performing combinations of the functions of the preceding machines, etc., may be included.

The term "process cartridge" means a cartridge in which an electrophotographic photosensitive drum, and at least one of the processing means, for example, a charging means, a developing means, a cleaning means, etc., that performs a process on this drum, are integrally disposed, and which is removably mountable in the main assembly of an electrophotographic image forming apparatus.

It has been a common practice to attach a memory tag (storage means) capable of storing information, to a process cartridge (which hereafter will be referred to as a cartridge). The memory tag is used to control a process cartridge to obtain optimal performance of the cartridge.

There are two types of methods for enabling a memory tag and the main assembly of an image forming apparatus (which hereafter will be referred to as an apparatus main assembly) to communicate with each other: the noncontact type method and the contact type method. The contact type communication method is inexpensive compared to the noncontact type. Therefore, the contact type communication method is more frequently employed than the noncontact type method.

The contact type communication method employs a connector which contacts the memory tag. The connector is attached to the apparatus main assembly. More specifically, it is connected to the communication control circuit of the apparatus main assembly. As the electrical contacts of this connector make contact with the surfaces of the memory tag, the communication control circuit and memory tag are enabled to communicate with each other.

If the connector remains in the position in which it contacts the memory tag, during the mounting or dismounting of a cartridge, it is possible that the contact points of the connector, or the contact surfaces of the memory tag, will be damaged. Therefore, it is common practice to structure an electrophotographic image forming apparatus so that when mounting or dismounting the cartridge, the connector is separated from the memory tag by the opening or closing movement of a member (which hereafter will be referred to as a door) for covering or exposing the opening of the apparatus main assembly.

In addition, in the case of the contact type communication method, if the connector and the memory tag separate from each other when the storage means and the apparatus main assembly are communicating with each other, data loss occurs. As one of the means to prevent this problem, there is the structural arrangement disclosed in U.S. Pat. No. 6,876,826. According to this arrangement, after it is detected with the use of a door switch that the door is opened, the process for properly ending the data communication is carried out, and then the connector and memory are separated from each other.

For reliable communication, the contact between the connector and the memory tag must be made after it is ensured that the cartridge is in a preset position in the apparatus main assembly, for the following reason. That is, in order to ensure that the cartridge is properly mounted into the apparatus main assembly, an operator sometimes pushes the cartridge inward when closing the door. Therefore, it is desired that the connector and the memory tag are placed in contact with each other just before the door is closed.

Further, as for the timing for separating the connector from the memory tag, in order to prevent data loss, it must be after the process for properly ending the communication between the storage means and the apparatus main assembly is completed after the state of the door (whether or not the door is open) is detected by the door switch. Thus, the timing for separating the connector from the memory tag must be such that the point in time at which the connector is separated from the memory tag is far apart from the point in time at which the door turns off the door switch.

In essence, it is desired that when the door is closed, the point in time at which the connector and the memory tag come into contact with each other is as close as possible to the end of the closing of the door, whereas, when the door is opened, the connector and the memory tag are separated from each other after the door switch is turned off by the opening movement of the door, and as close as possible to the end of the opening of the door.

However, the length of time from when the door switch detects the opening or closing of the door to when the memory tag and the connector separate from each other or come into contact with each other is greatly affected by the speed at which the door is opened or closed.

Therefore, the length of time to be afforded for the process for properly ending the communication between the storage means and the apparatus main assembly when separating the connector and the memory tag from each other must be set according to the shortest length of time necessary to open the door. Therefore, it is necessary to employ an electric circuit which is fast in data communication speed, inviting a cost increase.

SUMMARY OF THE INVENTION

Thus, a primary object of the present invention is to provide an electrophotographic image forming apparatus which ensures that when the door of the main assembly is opened or closed, the electrical contacts of its main assembly separate from the electrical contacts of a cartridge after the communication between its main assembly and the storage means of a process cartridge has properly ended.

According to an aspect of the present invention, there is provided an electrophotographic image forming apparatus for forming an image on an electrophotographic photosensitive member, the electrophotographic image forming apparatus including a process cartridge which contains the electrophotographic photosensitive member, process means actable on the electrophotographic photosensitive member, memory means for storing information, the memory means being provided with a cartridge contact, the electrophotographic image forming apparatus comprising i) an opening for mounting and demounting the process cartridge; (ii) an openable and closable member movable between an opening position for opening the opening and a closing position for closing the opening;

(iii) a detecting member for detecting a closing state of the openable and closable member; (iv) a connector member having a main assembly contact which is movable between a contact position where the main assembly contact contacts said cartridge contact and a separating position where the main assembly contact separates from the cartridge contact; (v) an operation member for moving the connector member from the separating position to the contact position; (vi) a holding member engageable with the operation member to hold the connector member at the contact position; (vii) control means for communicating with the memory means through the connector member after detection of a change of a signal outputted from the detecting member when the openable and closable member moves away from the closing position; (viii) a releasing mechanism for releasing engagement between the holding member and the operation member after the openable and closable member moves from the closing position toward the opening position by a predetermined distance; and (ix) an urging member for urging the connector member in a direction away from the contact position toward the separating position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment (1) Overall Structure of Image Forming Apparatus

Figure 1:
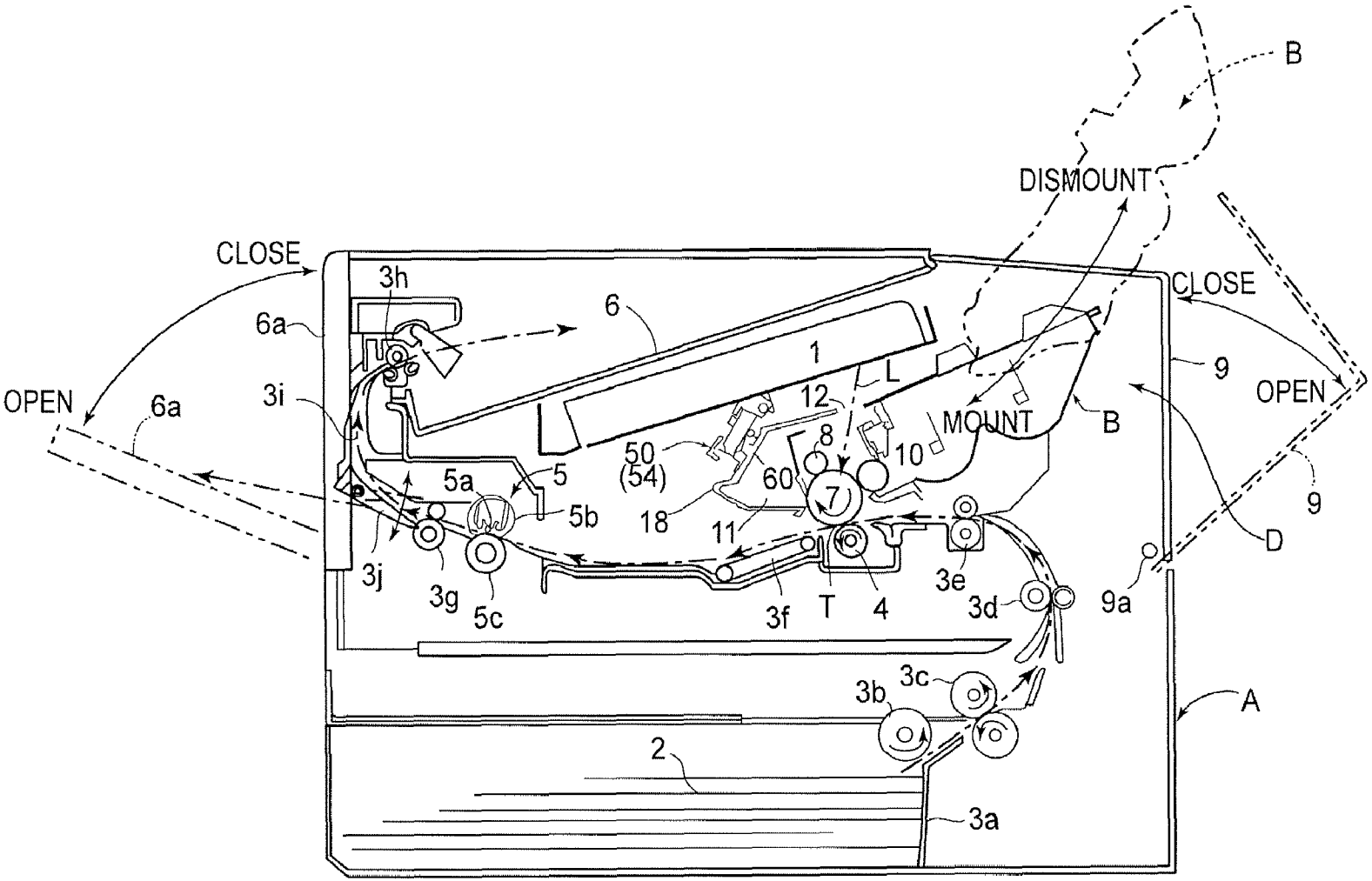
FIG. 1 is a schematic drawing of the image forming apparatus in one of the preferred embodiments of the present invention.

FIG. 1 is a schematic drawing of the image forming apparatus in this embodiment. This image forming apparatus is an electrophotographic laser beam printer A (which hereafter will be referred to as a printer) in which a process cartridge B (which hereafter will be referred to as a cartridge) is removably mountable.

This printer A outputs an image which it forms on a recording medium in accordance with the picture data inputted into the control circuit 100 (control board) from an external host apparatus 200 (FIG. 2) such as a computer. The control circuit 100 controls the signal exchanges among the external host apparatus and various processing devices of the printer A, the preset image formation sequence, etc.

The cartridge B has an electrophotographic photosensitive drum 7 (which hereafter will be referred to as a drum), which is a rotatable image bearing member. This drum 7 is rotationally driven in the clockwise direction indicated by an arrow mark, at a preset velocity in response to an image formation start signal. As the drum 7 is rotationally driven, the peripheral surface of the drum 7 is uniformly charged to a preset polarity and potential level by a charge roller 8 as a charging means. A laser scanner unit 1, as an optical (exposing) means, has a laser diode, a polygon mirror, a lens, a full-reflection mirror, etc., and outputs a beam of laser light L while modulating it with picture signals. The uniformly charged area of the peripheral surface of the drum 7 is exposed by this laser beam L. As a result, an electrostatic latent image which reflects the picture signals is formed. This latent image is developed by a developing apparatus 10, as a developing means, and developer (which hereafter will be referred to as toner), into a visible image, that is, an image formed of toner (which hereafter will be referred to as a toner image).

Meanwhile, a sheet of a recording medium 2 set in a sheet feeder cassette 3*a* is conveyed to a transfer station T by a pickup roller 3*b*, conveyance roller pairs 3*c*, 3*d*, and 3*e*, in synchronism with the abovementioned formation of the toner image on the drum 7.

In the transfer station T, a transfer roller 4, as a transferring means, is disposed in a manner to oppose the drum 7; it is disposed in contact with the drum 7, forming a transfer nip. The recording medium 2 is introduced into the transfer nip, and is conveyed through the transfer nip. While the recording medium 2 is conveyed through the transfer nip, a transfer bias is applied to the transfer roller 4. As a result, the toner image on the drum 7 is transferred onto the surface of the recording medium 2.

After receiving the toner image, the recording medium 2 is separated from the drum surface, and is conveyed by a conveyance guide 3*f* to a fixing apparatus 5 as a fixing means.

After the separation of the recording medium 2 from the drum surface, the drum surface is cleared of adherent residues, such as the toner remaining on the drum surface after the transfer, by a cleaner 11 as a cleaning means, being readied for the next image formation operation (the drum surface is repeatedly used for image formation).

The fixing apparatus 5 has a driver roller 5*c*, and a hollow fixation roller 5*b* which contains a heater 5*a* therein. The recording medium 2 is introduced into the fixation nip formed by the driver roller 5*c* and fixation roller 5*b*, and is conveyed through the fixation nip. While the recording medium 2 is conveyed through the fixation nip, the fixing apparatus 5 applies heat and pressure to the recording medium 2, fixing thereby the transferred toner image to the recording medium 2.

After being conveyed through the fixation nip, the recording medium 2 is conveyed between a pair of discharge rollers 3*g*, through a reversal path 3*i*, and between a pair of discharge rollers 3*h*. Then, it is discharged into a delivery tray 6 which constitutes a part of the top surface of the printer A.

Incidentally, it is possible to rotate a flapper 3*j* to allow the recording medium 2 to advance straight so that after the recording medium 2 comes out of the interface between the pair of discharge rollers 3*g*, the recording medium 2 is discharged into a second delivery tray 6*a*, instead of entering the reversal path 3*i*.

The abovementioned pickup roller 3*b*, conveyance roller pairs 3*c*, 3*d*, and 3*e*, conveyance guide 3*f*, discharge roller pairs 3*g* and 3*h*, etc., constitute the means for conveying the recording medium 2.

In this embodiment, the drum 7, the processing means, more specifically, the charge roller 3, the developing means 10, and cleaner 11, are integrally disposed in a cartridge, making up the process cartridge B which is removably mountable in the main assembly of the printer A.

The top portion of the main assembly of the printer A is provided with a door 9, which can be opened or closed to expose or cover the opening D of the main assembly A, through which the cartridge B is mounted or dismounted. The cartridge B can be mounted or dismounted by exposing the abovementioned opening D by rotating the door 9 about the hinge shaft 9*a* to the position contoured by the two-dot chain line in FIG. 1.

As the door 9 is opened, the cartridge bay in the main assembly of the printer A becomes visible. As seen from the opening D side, a pair of guide rails (unshown) are visible, which are on the left and right walls of the cartridge bay, one for one. The guide rails are downwardly inclined toward the rear. When mounting the cartridge B into the cartridge bay, the cartridge B is to be held, with its front side (developing apparatus side) facing the front side of the main assembly of the printer A, so that the cartridge B can be inserted from its rear side (cleaner side). More specifically, a pair of positioning bosses, which outwardly project from the left and right lateral walls (as seen from front side of the main assembly A) are to be rested on the abovementioned left and right guide rails, one for one. The axial lines of the pair of bosses coincide with the axial line of the drum 7. Then, the cartridge B is to be inserted all the way into the cartridge bay. As the cartridge B is inserted all the way into the cartridge bay, the abovementioned positioning bosses fit into the cartridge positioning grooves (unshown) of the main assembly of the printer A, locking the cartridge B into the preset image formation position in the main assembly of the printer A. Then, the door 9 is to be closed.

When the cartridge B is in the preset image formation position, the exposure opening 12 of the cartridge B, with which the top wall of the cartridge B is provided, faces a specific area of the laser scanner unit 1. Further, as the cartridge B is moved inward of the cartridge bay during the mounting of the cartridge B, the drum cover (unshown), which constitutes a part of the bottom wall of the cartridge B, is opened, exposing thereby the opening, with which the bottom wall of the cartridge B is provided. As a result, the downwardly facing area of the peripheral surface of the drum 7 is allowed to contact the transfer roller 4, through the opening of the cartridge B, forming a transfer nip. Further, the mechanical and electrical connections are made between the cartridge B and main assembly of the printer A, enabling the printer A to perform an image forming operation. That is, it becomes possible for the drum 7, and the development roller, the toner stirring member, etc., of the developing apparatus 10, to be driven by the driving means (unshown) with which the main assembly of the printer A is provided. Further, it becomes possible for a charge bias and a development bias to be applied to the charge roller 8 and development sleeve, respectively, from the electric power supplying means (unshown) on the printer main assembly side. Moreover, an electrical connection is established between the electrical sensor (unshown) on the cartridge B side and the control circuit 100 on the main assembly side of the printer A.

Figure 2:
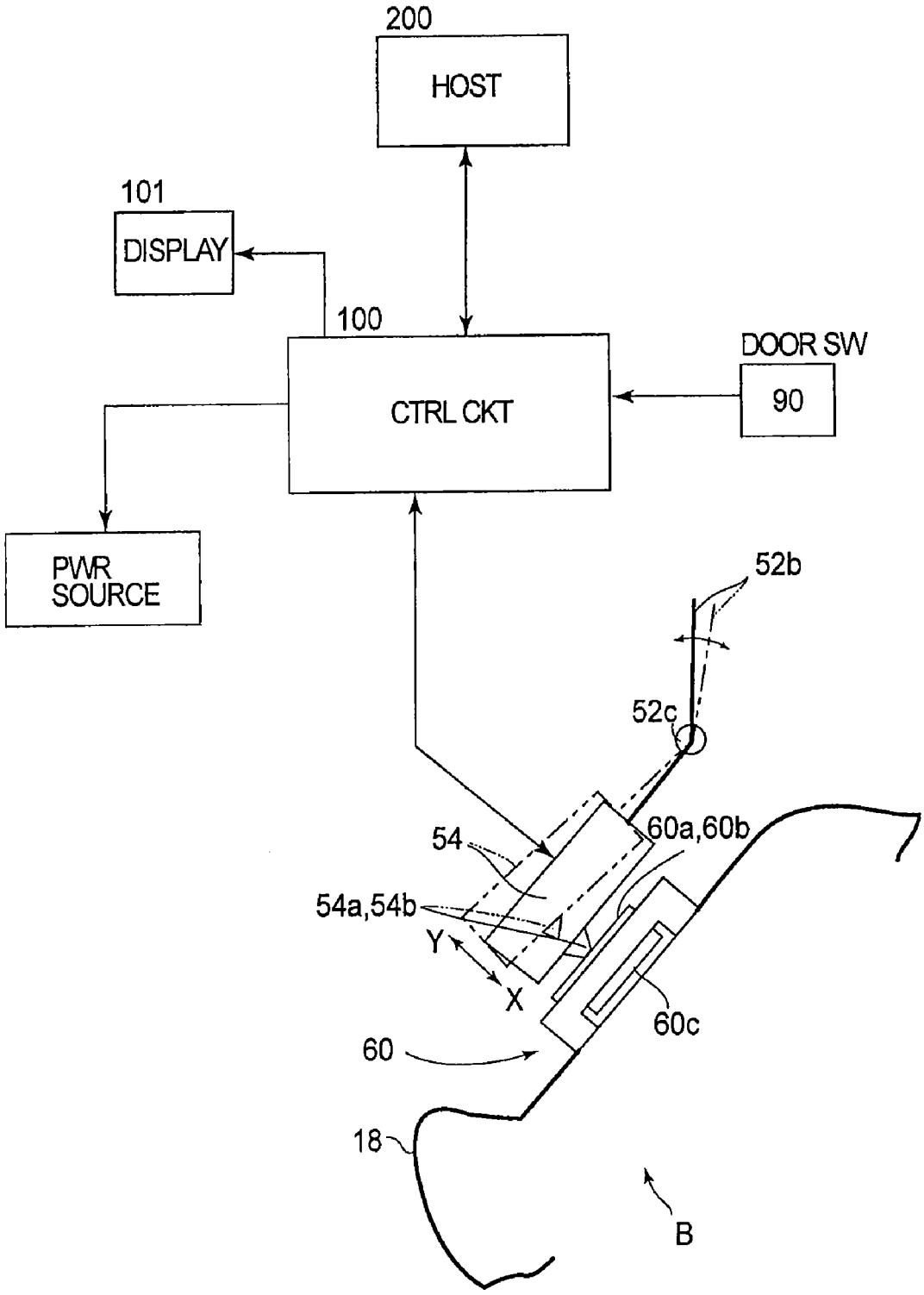
FIG. 2 is a block diagram of the control system.

Further, referring to FIG. 2, as the cartridge B is mounted into the main assembly of the printer A, the electrical contacts 60*a* and 60*b* (cartridge contacts) of the storage means 60 (memory tag) attached to the drum supporting portion 18 of the frame of the cartridge B come into contact with the electrical contacts 54*a* and 54*b* (main assembly contacts) of the connector 54 on the main assembly side of the printer A, respectively. As a result, the storage means 60, and a control circuit 100 on the main assembly side of the printer A, are enabled to communicate with each other (contact communication method).

When removing the cartridge B from the main assembly of the printer A, the above described sequence for mounting the cartridge B is to be carried out in the reverse order. That is, referring to FIG. 1, first, the door 9 is to be opened, and the cartridge B is to be pulled rightward in the diagonally upward direction in FIG. 1. As the cartridge B is pulled, the cartridge B comes out of the main assembly of the printer A, while being guided by the abovementioned guide rails. As the cartridge B is moved outward, the drum cover closes, covering thereby the opening, with which the bottom wall of the cartridge B is provided. Therefore, the internal components of the cartridge B are protected while the cartridge B is out of the main assembly of the printer A.

(2) Storage Means 60 and Connector 54

In this embodiment, the storage means 60 is attached to the drum supporting frame 18. More concretely, it is attached to the rear surface of the cartridge B, that is, the surface of the cartridge B, which is on the leading side of the cartridge B in terms of the direction in which the cartridge B is inserted into the main assembly of the printer A.

The storage means 60 is a means for storing the information related to the cartridge and the image forming apparatus. More specifically, the storage means 60 is provided with a memory chip 60*c*, such as a RAM or a ROM, which is a storage element and is attached to the rear surface of the storage means 60. Necessary information, for example, the cartridge lot number, initial values for image formation conditions, the history of an image forming apparatus, characteristics of the image forming apparatus, characteristics of the processing means of the image forming apparatus, etc., are inputted in advance into the memory chip 60*c*. When the cartridge B is properly set in the image formation position in the main assembly of the printer A and the connector 54 is in contact with the storage means 60, the exchange of the information between the storage means 60 and control circuit 100 is possible, making it possible to control the process of informing the control circuit 100 of the information regarding the condition of the cartridge B and the history of the cartridge usage to use the information for an image forming operation, the process of making an operator recognize the condition of the cartridge B by displaying the condition on a displaying device 101, and the like. Further, the memory chip 60*c* is writable even during its usage. Therefore, the information is written into the memory chip 60*c* whenever necessary.

The connector 54, which is the connector on the main assembly side of the printer A, is held by a connector supporting member 50, in such a manner that when the cartridge B is mounted into in the image formation position in the main assembly of the printer A, the connector 54 faces the storage means 60 of the cartridge B. The connector 54 has a springy member having the electrical contacts 54*a* and 54*b* (main assembly contacts) which electrically contact the electrical contacts 60*a* and 60*b* of the storage means 60. Further, the connector 54 is electrically connected to the control circuit 100 with the use of bundled wires (unshown).

As will be described next, the main assembly of the printer A and the cartridge B are structured so that the connector 54 held by the connector supporting member 50 is moved into the communication-possible position X (FIG. 2) in which the contacts 54*a* and 54*b* contact the contacts 60*a* and 60*b*, respectively, by a connector moving mechanism (connector engaging member) which is moved by the closing (or opening) movement of the door 9.

Further, the main assembly of the printer A is structured so that after the connector moving mechanism moves the connector 54 into the communication-possible position X, the connector moving mechanism is retained by a connector retaining mechanism (retaining member), in the position in which it finishes moving the connector 54 into the communication-possible position X.

Further, the main assembly of the printer A is structured so that as the door 9 is opened, the mechanism for retaining the connector moving mechanism is disengaged from the connector moving mechanism by the opening movement of the door 9, allowing the connector moving mechanism to move the connector 54 into the retreat position Y in which the electrical contacts 54*a* and 54*b* are prevented from contacting the electrical contacts 60*a* and 60*b*, respectively.

Further, not only is the main assembly of the printer A structured so that the connector mechanism is moved between the communication-possible position X (contact establishment position) and the retreat position Y (separation position), but also, so that the length of time it takes for the electrical contacts of the memory tag to disengage from their counterparts after the detection of the opening of the door 9 by the door switch 90 as a detecting means, is kept longer than a preset value to ensure that the communication between the memory tag 60 and the main assembly of the printer A has properly ended.

To more concretely describe the abovementioned structural arrangement, the main assembly of the printer A is structured so that when the door 9, which was open, is closed, the connector moving mechanism 55 is moved from the position corresponding to the retreat position Y (disengagement position) to the position corresponding to the communication-possible position X (engagement position) by the movement of the door 9 at a speed proportional to the moving speed of the door 9, whereas when the door 9, which has been closed, is opened, the connector moving mechanism 55 is retained in the position corresponding to the communication-possible position X by the connector moving mechanism retaining mechanism 58 (which hereafter will be referred to as a retaining mechanism) until the door 9 is opened to a preset position. As the door 9 is opened beyond the preset position, the retaining mechanism disengaging mechanism (81-84) (which hereafter will be referred to as a disengaging mechanism), which will be described later, is activated, disengaging the retaining mechanism 58, and therefore, allowing the connector moving mechanism 55 to move from the position corresponding to the communication-possible position X to the position corresponding to the retreat position Y. With the provision of this structural arrangement, the overall moving speed of the connector moving mechanism remains constant regardless of the speed at which the door 9 is opened or closed, which characterizes this embodiment (present invention).

Figure 3:
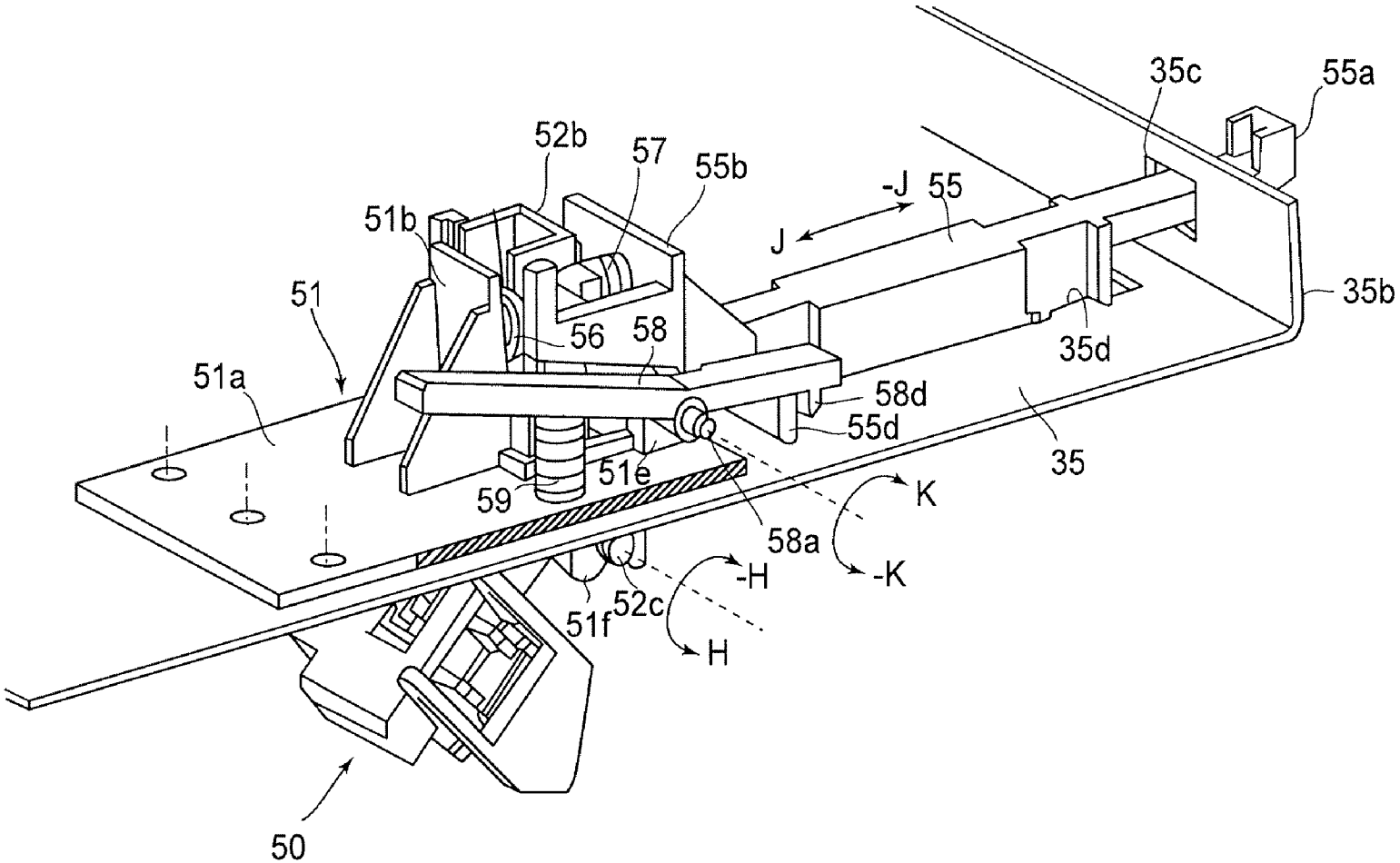
FIG. 3 is a perspective view of the connector supporting member, the connector supporting member moving member, the retaining member, and the disengaging mechanism, as seen from above.
Figure 4:
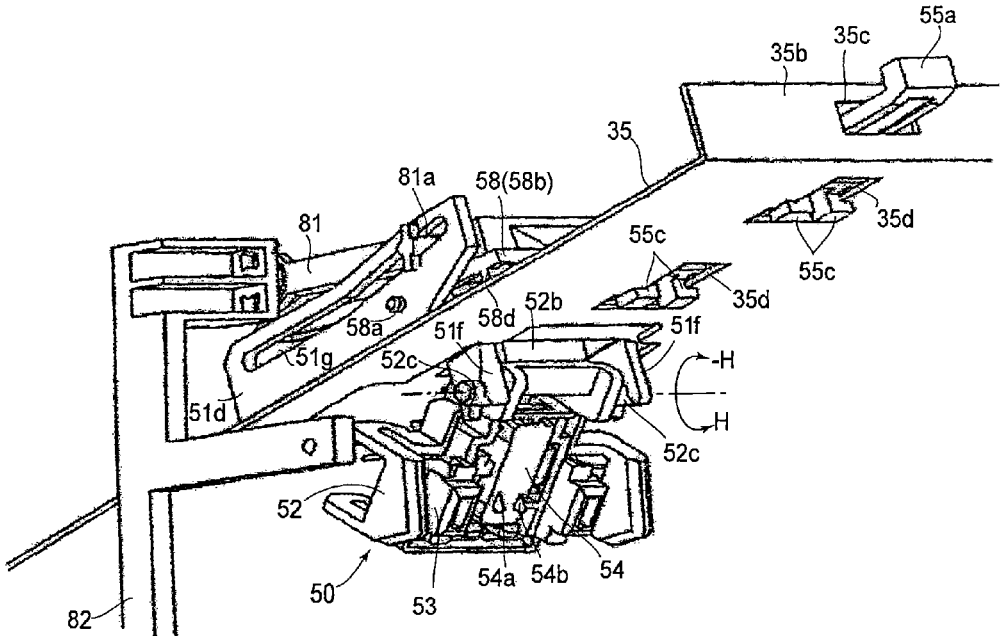
FIG. 4 is a perspective view of the connector supporting member, the connector supporting member moving member, the retaining member, and the disengaging mechanism, as seen from below.

FIGS. 3 and 4 are perspective views of the assembly of the above described connector supporting member 50, the connector moving mechanism 55, the retaining mechanism 58, and the disengaging mechanism (81-82), as seen from diagonally above and below, respectively.

Figure 5:
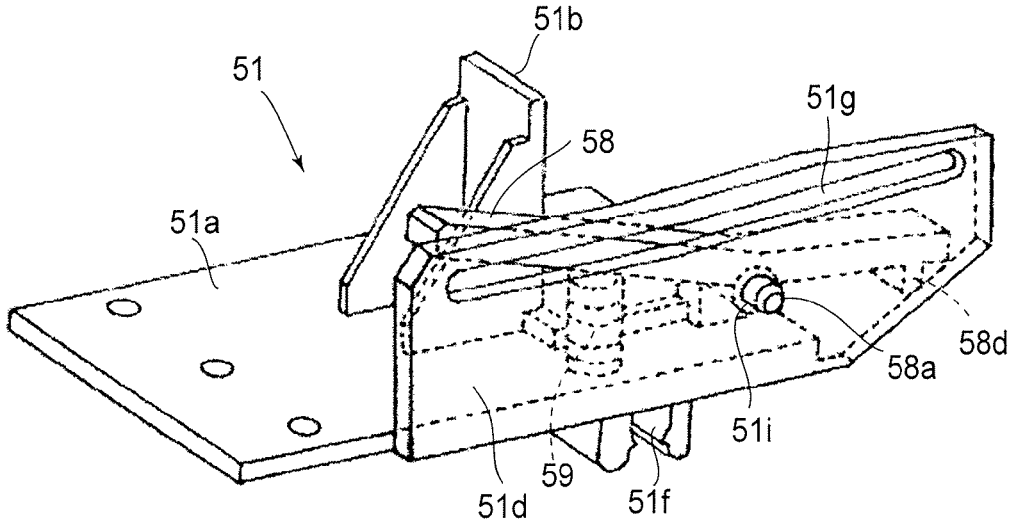
FIG. 5 is an external perspective view of the housing.
Figure 6:
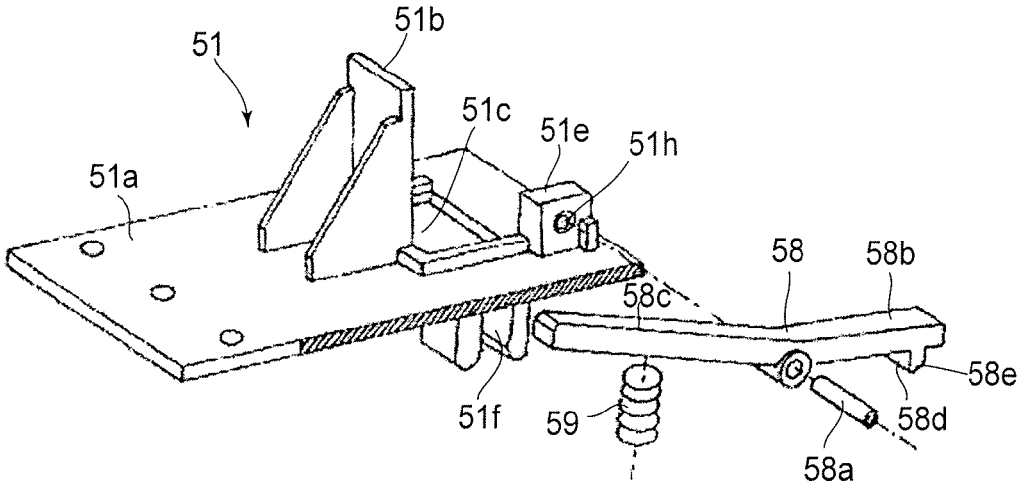
FIG. 6 is an exploded and partially cutaway perspective view of the housing.

The connector supporting member 50 and the other mechanical components are attached to a housing 51. FIG. 5 is an external perspective view of the housing 51, and FIG. 6 is a partially cutaway exploded perspective view of the housing 51. The housing 51 has: a support plate 51*a*; a pressure catching plate 51*b* perpendicularly attached to the top surface of the support plate 51*a*; a through hole 51*c*, with which the front side of the support plate 51*a*, relative to the pressure catching plate 51*b*, is provided; and a lateral plate 51*d* which perpendicularly projects from the front edge (in FIG. 5) of the support plate 51*a*. The housing 51 also has: a bearing plate 51*e* which perpendicularly projects from the support plate 51*a*, with the provision of a preset distance between the bearing plate 51*e* and inward surface of the lateral plate 51*d*; and a pair of bearings 51*f* (left and right bearings) which perpendicularly project from the bottom surface of the support plate 51*a*, with the left and right bearings 51*f* positioned on the left and right sides of the through hole 51*c*. Further, the lateral plate 51*d* is provided with a long slot 51*g* which extends in the front-to-rear direction of the apparatus.

Figure 14:
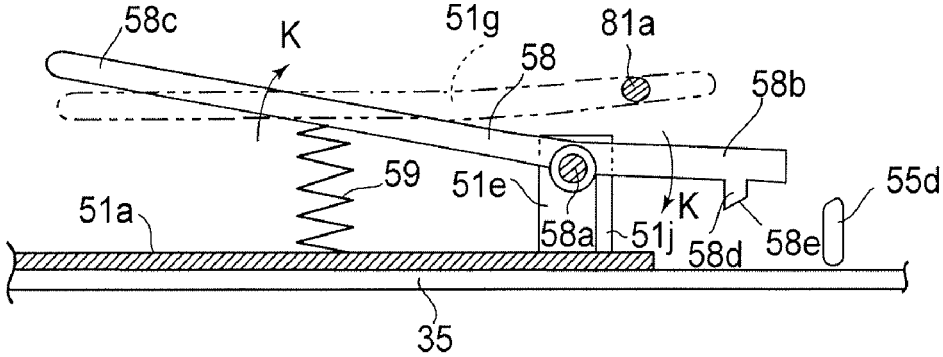
FIG. 14 is a drawing showing the movement (1) of the retaining member.

On the inward side of the lateral plate 51*d*, the retaining member 58 is held between the bearing plate 51*e* and the lateral plate 51*d*, by a shaft 58*a*, one end of which is fitted in the bearing hole 51*h* of the bearing plate 51*e*, and the other end of which is fitted in the bearing hole 51*i* of the lateral plate 51*d*, which opposes the bearing hole 51*h*. This retaining member 58 is in the form of a lever, and is disposed in parallel to the lateral plate 51. It is rotationally movable about the shaft 58*a*. It has first and second arm portions 58*b* and 58*c*, which constitute the front and rear portions, respectively, of the retaining member 58, with reference to the shaft 58*a*, and form a slight angle relative to each other, giving the retaining member 58 a shallow V-shape. The end portion of the retaining member 58, which is on the arm portion 58*b* side, is provided with a downward projection 58*d*. Between the second arm portion 58*c* and support plate 51*a*, a compression spring 59 is disposed to push the retaining member 58 upward. Thus, the retaining member 58 remains slightly pressured by this spring 58 in a direction to rotate in the clockwise direction indicated by an arrow mark K in FIG. 3, about the shaft 58*a*. Therefore, when the retaining member 58 is free from the pressure other than that from the spring 59, the retaining member 58 is kept in the attitude (at an angle) shown in FIG. 14. That is, the bottom surface of the base side of the first arm portion 58*b* is kept in contact with a stopper projection 51*j*, with which the bearing plate 51*e* is provided, as shown in FIG. 14, preventing the retaining member 58 from further rotating in the clockwise direction. When the remaining member 58 is kept in the above described state, the first arm portion 58*b* is at a level which is lower than that of the long slot 51*g* of the lateral plate 51*d*, and the second arm portion 58*c* is slanted so that the end portion (rear end portion of retaining member) is positioned higher than the base portion, in a manner to intersect with the long slot 51*g*.

The above-mentioned housing 51 is disposed on the frame 35 which supports the laser scanner unit 1. More specifically, the frame 35 is provided with a roughly rectangular through hole 35*a* (FIG. 9), and the left and right bearings 51*f* projecting from the bottom surface of the support plate 51*a* are put through this roughly rectangular through hole 35*a* so that the left and right bearings 51*f* project beyond the bottom surface of the frame 35. Then, the support plate 51*a* is fixed to the frame 35 with the use of small screws. The through hole 51*c* of the support plate 51*a* corresponds in position to the through hole 35*a* of the frame 35.

Figure 7:
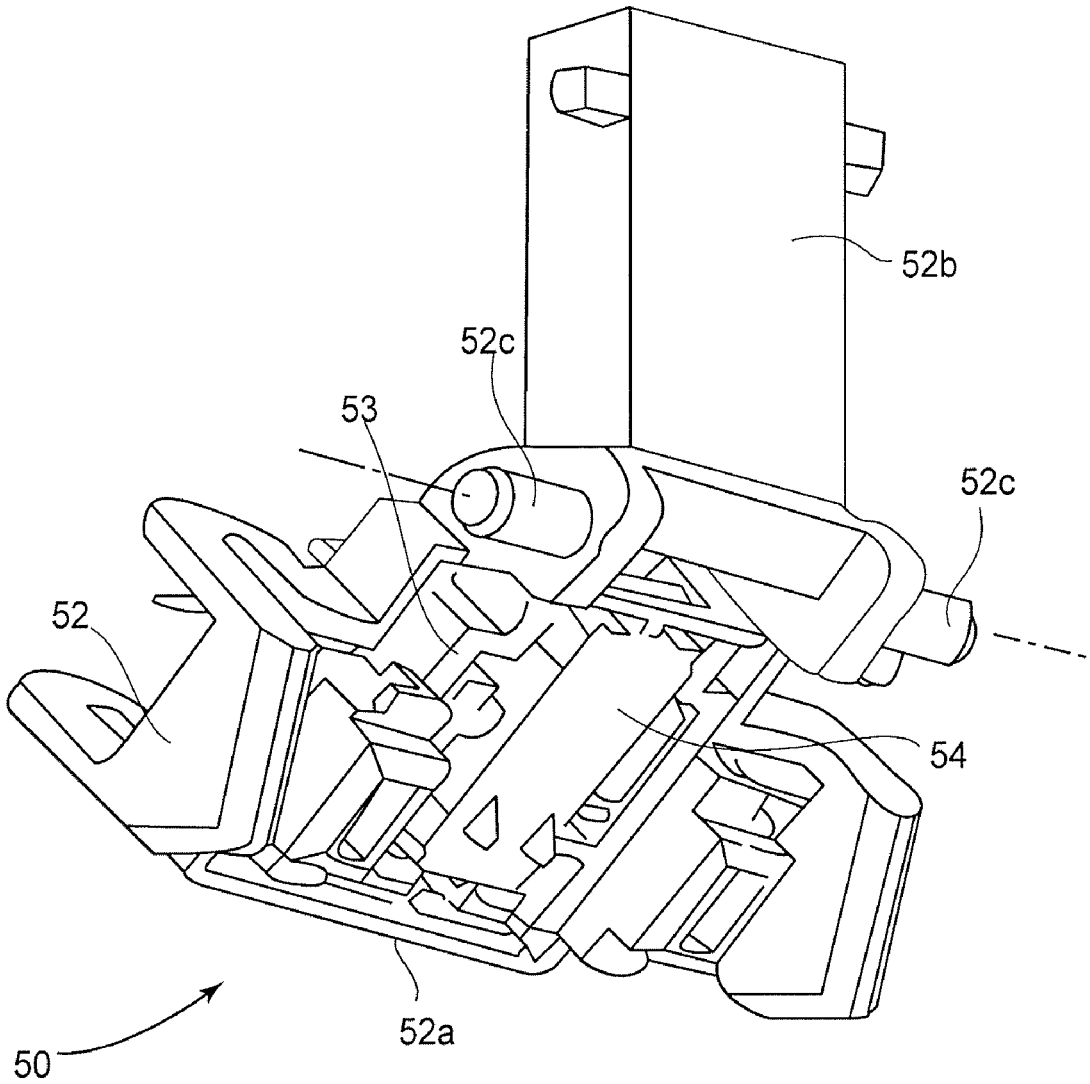
FIG. 7 is an external perspective view of the connector supporting member.
Figure 8:
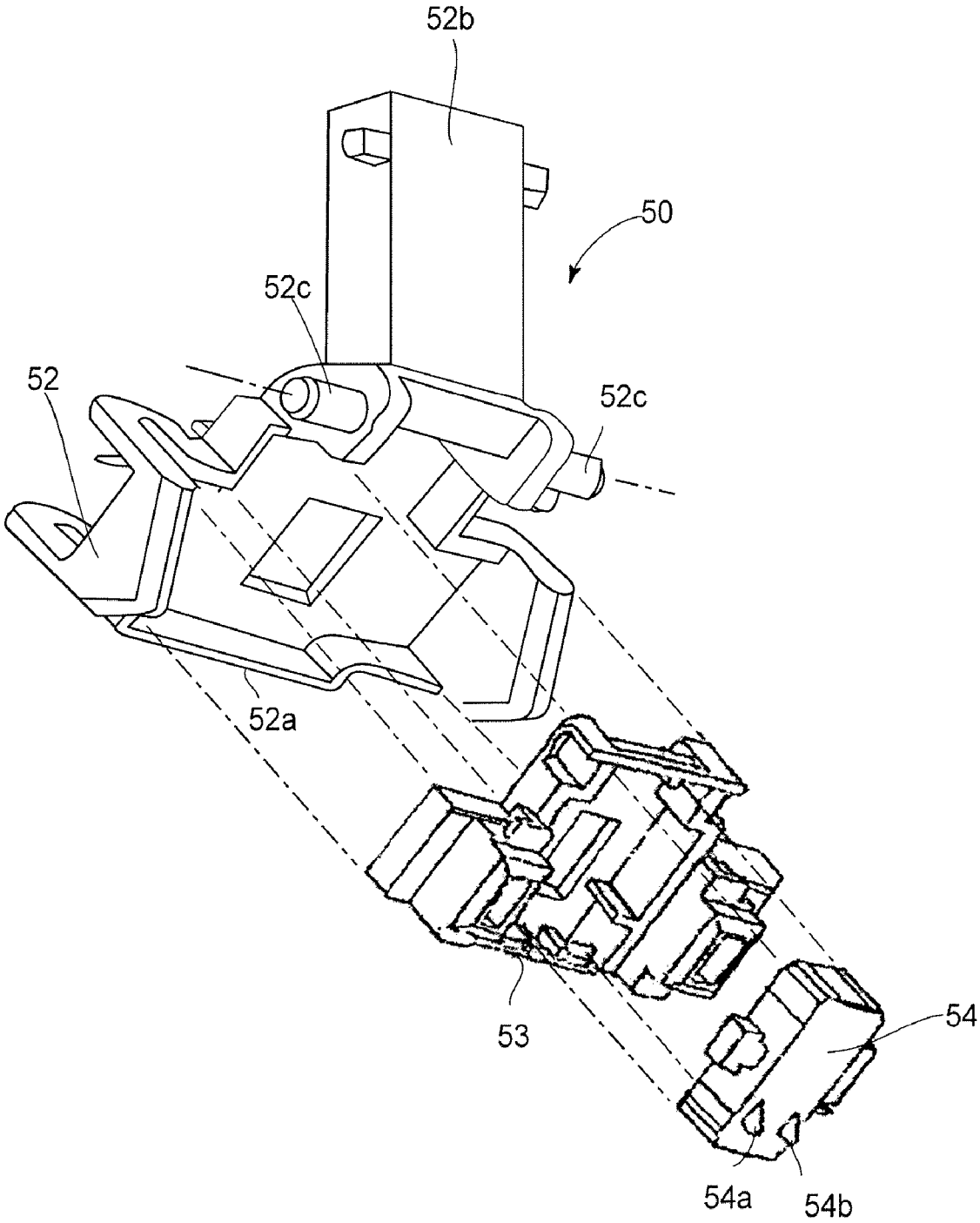
FIG. 8 is an exploded perspective view of the connector supporting member.

FIG. 7 is an external perspective view of the connector supporting member 50, and FIG. 8 is an exploded perspective view of the connector supporting member 50. The connector supporting member 50 has first and second supporting members 52 and 53, and a connector 54. The first supporting member 52 has: a frame 52*a* which engages with the second supporting member 53; an upward arm 52*b*, with which the frame 52*a* is provided; and a pair of shafts 52*c*, which project left- and rightward, one for one, from the joint portion between the frame 52*a* and the upward arm 52*b*. The second supporting member 53 is a member in which the connector 54 is fitted. The connector 54 is pressed into the frame-like portion of this second supporting member 53. As a result, the connector 54 is securely held to the second supporting member 53 by the locking claws of the second supporting member 53. Then, the second supporting member 53 is pushed into the frame-like portion 52*a* of the first supporting member 52, being thereby securely held to the first supporting member 52 by the locking claws of the first supporting member 52. That is, the connector 54 is securely held to the first supporting member 52, with the placement of the second supporting member 53 between the connector 54 and first supporting member 52.

The upward arm 52*b* of the first supporting member 52 is put through the roughly rectangular through hole 35*a* and through hole 51*c*, from the bottom surface side of the frame 35, so that the upward arm 52*b* projects upward past the support plate 51*a* of the housing 51. Further, the left and right shafts 52*c* of the first supporting member 52 are inserted into the left and right bearings 51*f* of the housing 51, which project downward beyond the bottom surface of the frame 35, so that the first supporting member 52 is held to the frame 35. As a result, the connector supporting member 50 is held to the housing 51 so that it is rotatable about the shafts 52*c*, and also, so that the upward arm 52*b* is positioned on the front side of the pressure catching plate 51*b* of the housing 51.

Figure 9:
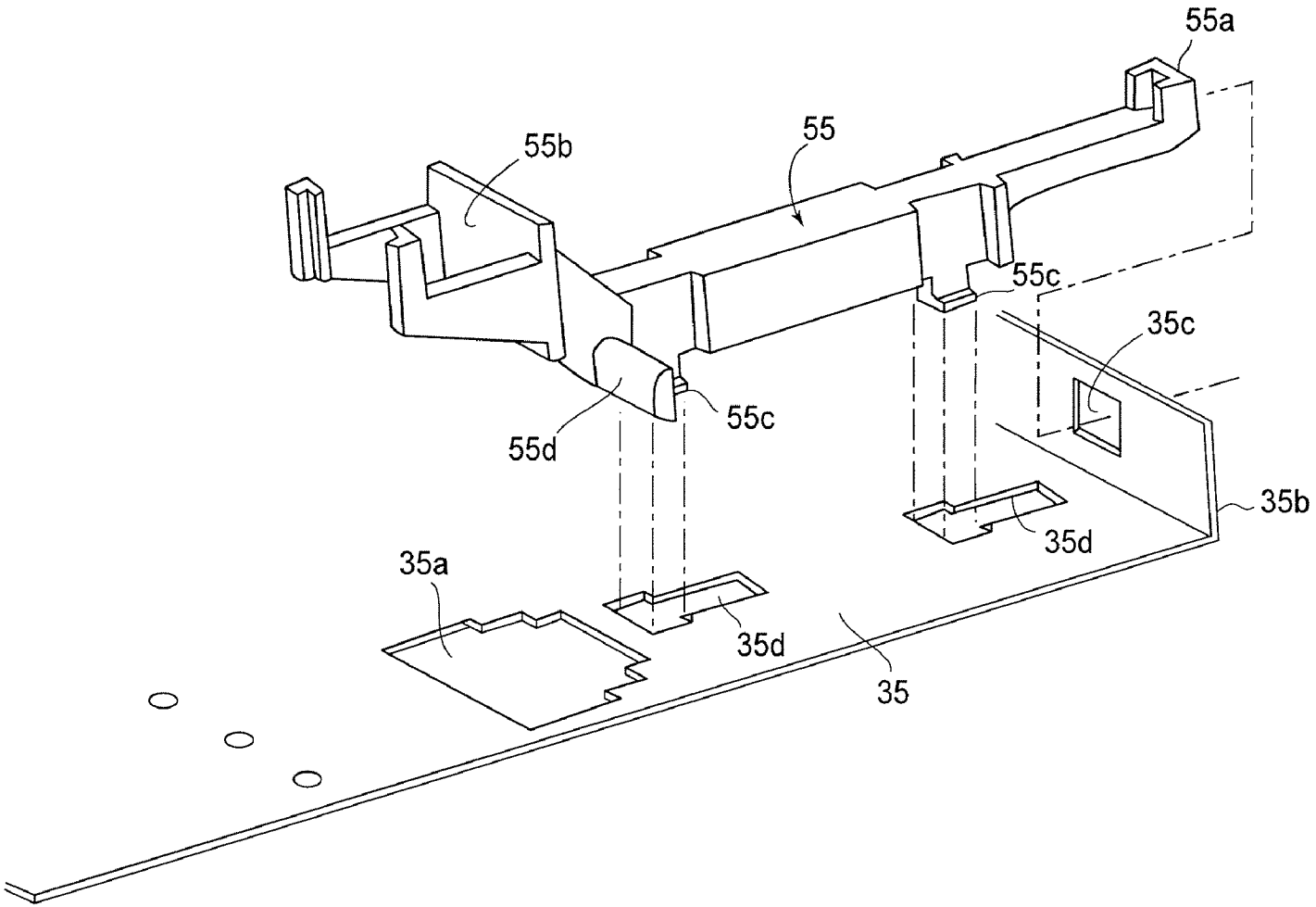
FIG. 9 is an exploded perspective view of the connector supporting member moving member and a part of the frame.

On the front side of the housing 51, a rod 55 is disposed so that it can be slid frontward or rearward on the frame 35. FIG. 9 is an external perspective view of this rod 55. The rod 55 has: a door contacting portion 55*a*, which constitutes the front end portion; a pusher plate portion 55*b*, which constitutes the rear end portion; front and rear pairs of locking claws 55*c*, which project from the bottom surface of the rod 55; and a projection 55*d*, which perpendicularly projects from the lateral surface of the rear end portion of the rod 55.

The front wall 35*b* of the frame 35 is provided with a hole 35*c*. The door contacting portion 55*a*, that is, the front end portion, of the rod 55 is put through this hole 35*c* so that the door contacting portion 55*a* projects beyond the front wall 35*b*. Further, the frame 35 is provided with the front and rear slits 35*d*. The front and rear pairs of locking claws 55*c* projecting from the bottom surface of the rod 55 are put through these front and rear slits 35*d*, one for one. As a result, the rod 55 is secured to the frame 35 in such a manner that it is allowed to slide frontward or rearward on the frame 35, within a range which corresponds to the length of the slits 35*d*, and also, so that the pusher plate portion 55*b* is positioned on the front side of the upward arm 52*b* of the connector supporting member 50.

Between the pressure catching plate 51*b* of the housing 51 and the upward arm 52*b* of the connector supporting member 50, a first coil spring 56, as a pressure applying member, is disposed. Further, between the upward arm 52*b* of the connector supporting member 50 and the pusher plate portion 55*b* of the rod 55, a second coil spring 57 is disposed.

When the door 9 is open, more specifically, when the angle of the door 9 relative to the printer main assembly is no less than a preset value, the rod 55 is in the advanced position in its movable range which corresponds in size to the length of the slit 35*d*; the rod has been pushed back toward the front wall 35*b* of the frame 35 (–J direction in FIG. 3) by the resiliency of the springs 56 and 57. Referring to FIG. 14, when the rod 55 (door 9) is in the above described position, the projection 55*d* of the rod 55 is on the front side of the downwardly protruding projection 58*d* of the retaining member 58. Further, the connector supporting member 50 is under the pressure applied to the upward arm 52*b* by the resiliency of the spring 56 in the direction to rotate the connector supporting member 50 about the shaft 52*c* in the –H direction in FIGS. 3 and 4, as shown in FIG. 14. Therefore, the connector 54 is retained in the retreat position Y (FIG. 2), in which it is impossible for the electrical contacts 54*a* and 54*b* to contact the electrical contacts 60*a* and 60*b* of the storage means 60.

(2-1) Door Closing Operation

Figure 10:
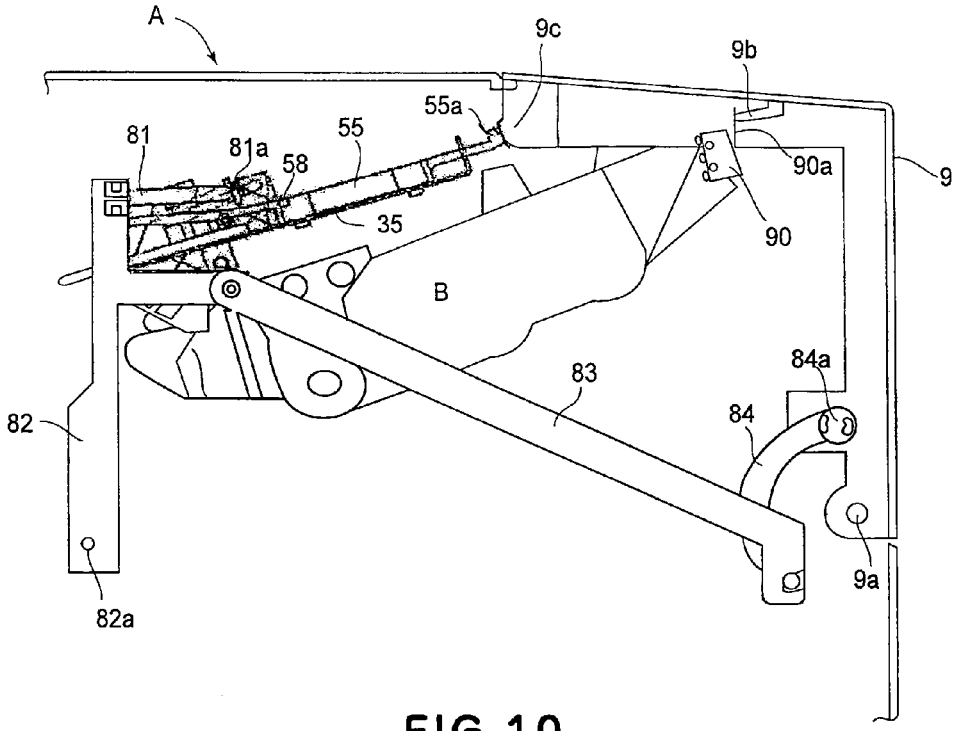
FIG. 10 is a schematic drawing the image forming apparatus, the door of which is completely shut, showing the structure thereof.

FIG. 10 show the printer A, the door 9 of which has been shut after the mounting of the cartridge B into the main assembly of the printer A.

Figure 15:
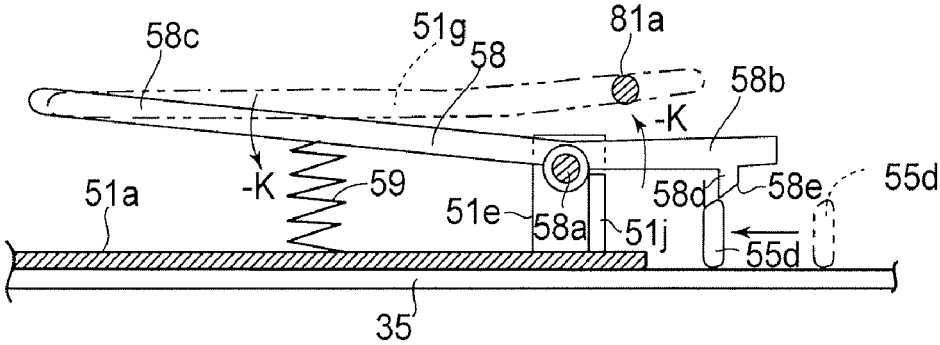
FIG. 15 is a drawing showing the movement (2) of the retaining member.
Figure 16:
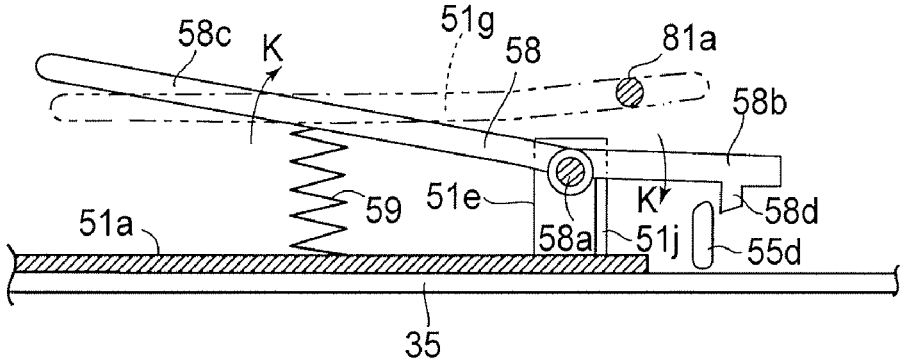
FIG. 16 is a drawing showing the movement (3) of the retaining member.

As the door 9 is closed by a user after the mounting of the cartridge B into the main assembly of the printer A, the rod pushing mechanical contact portion 9*c* of the door 9 comes into contact with the door contacting portion 55*a*, that is, the front end portion, of the rod 55. As a result, the rod 55 is made to retract by the door 9 in the direction indicated by an arrow mark J in FIG. 3. While the rod 55 is made to retract by the door 9, the top edge portion of the projection 55*d* of the rod 55 comes into contact with the downwardly facing slanted surface 58*e* (which functions as cam) of the downwardly projecting projection 58*d* of the first arm portion 58*b* of the retaining member 58, and pushes up the downwardly projecting projection 58*d*. Therefore, the retaining member 58 is rotated, against the spring 59 as the second pressure applying means, about the shaft 58*a* in the counterclockwise direction indicated by an arrow mark –K in FIG. 15, allowing the projection 55*d* to move past the downward projection 58*d*, on the under side the downward projection 58*d*. As soon as the projection 55*d* moves past the under side of the downward projection 58*d*, the retaining member 58 is rotated about the shaft 58*a* in reverse, that is, in the clockwise direction indicated by an arrow mark K, by the resiliency of the spring 59, as shown in FIG. 16. As a result, the retaining member 58 is caught by the stopper projection 51*j*, being prevented from further rotating in reverse. Thereafter, the retaining member 58 is retained in the same attitude as that shown in FIG. 14; in other words, the projection 55*d* is positioned on the inward side of the downward projection 58*d*.

Further, the upward arm 52*b* of the connector supporting member 50 is pushed by the pusher plate 55*b* of the rod 55, that is, the rear end portion of the rod 55, with the presence of the spring 57 between the upward arm 52*b* and the pusher plate 55*b*. Thus, the spring 56 is compressed by the upward arm 52*b* and the pressure catching plate 51*b* of the housing 51. Therefore, the connector supporting member 50 is rotated about the shaft 52*c* in the direction H in FIGS. 3 and 4, placing thereby the connector 54 in the communication-possible position X, shown in FIG. 2, in which the electrical contacts 54*a* and 54*b* are in contact with the electrical contacts 60*a* and 60*b* of the storage means 60. The connector 54 is kept in this state as long as the door 9 remains locked to the main assembly of the printer A, that is, as long as the door 9 remains shut, and therefore, the rod 55 is prevented from returning in the –J direction.

The spring 57 is designed so that the amount of pressure it generates is greater than the total amount of pressure which the contacts 54*a* and 54*b* of the connector 54, which are springy members, generate. Therefore, as long as the distance by which the rod 55 is pushed into the frame 35 is greater than a preset value, the spring 57 generates a proper amount of pressure for keeping the connector 54 pressed upon the storage means 60. In other words, as long as the door 9 is properly shut, the connector 54 and storage means 60 are reliably kept in contact with each other.

Next, the disengaging mechanism (81-84) will be described. The door 9 is rotatable about the stationary shaft 9*a* to be opened or closed. The door 9 is provided with an arm 84, which is located on the inward side, near the shaft 9*a*. This arm 84 is in the form of an arc, the center of which coincides with the axial line of the shaft 9*a*. The base portion 84*a* of the arm 84 is solidly fixed to the door 9. The lever 82, which is rotatable about the shaft 82*a*, is connected to the abovementioned arm 84 of the door 9, with the use of a first linking member 83. The lever 82 is provided with a second linking member 81, which is attached to the top end portion of the lever 82 so that the second linking member 81 is rotatable about the connective member, with which the second linking member 81 is connected to the level 82. The second linking member 81 is provided with a projection 81*a*, which is attached to the opposite end of the linking member 81 from the end by which it is connected to the lever 82. The projection 81*a* is fitted in the long slot 51*g*, with which the aforementioned lateral plate 51*d* of the housing 51 is provided. Therefore, the moving range and direction of the projection 81*a* is controlled by the long slot 51*g*. Further, while the projection 81*a* moves along the long slot 51*g*, it comes into contact with the top surface of the retaining member 58.

When the door 9 is shut, the arm 84, the first linking member 83, the lever 82, and the second linking member 81 are positioned as shown in FIG. 10, and the projection 81*a* of the second link 81 is in the front end portion of the long slot 51*g*, as shown in FIG. 16. When the projection 81*a* is in the position shown in FIG. 16, it is above (being therefore apart from) the first arm portion 58*b* of the retaining member 58, and therefore, does not interfere with the retaining member 58.

The main assembly of the printer A is provided with a switch 90 (door switch) for detecting the state of the door 9, that is, whether the door 9 is open or closed. When the door is closed, the actuator 90*a* of the switch 90 is kept pressed by the projection 9*b* of the door 9, and therefore, the switch 90 is kept turned on, whereas as the door 9 is opened, the pressure applied to the actuator 90 by the projection 9*b* is removed, and therefore, the switch 90 is turned off, and remains turned off. This ON or OFF signal generated by the switch 90 as the door 9 is closed or opened is used to detect whether the door is closed or opened.

(2-2) Initial Stage of Opening of Door 9

Figure 11:
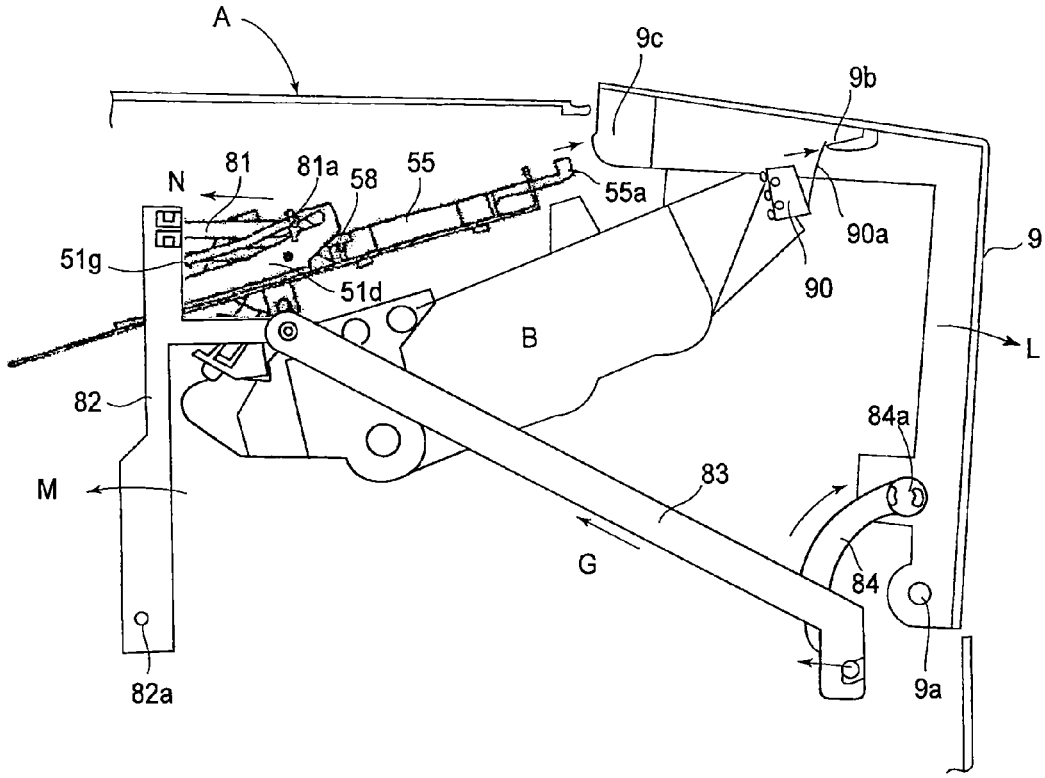
FIG. 11 is a schematic drawing of the image forming apparatus, the door of which is in the first stage of opening.

When replacing the cartridge B in the printer A with another cartridge B, dealing with a paper jam, checking up on the interior of the main assembly of the printer A, or carrying out the like processes, the door 9 is to be opened. FIG. 11 shows the state of main assembly of the printer A in the initial stage of the opening of the door 9.

As the door 9 is rotated about the shaft 9*a* in the clockwise direction L so that the angle between the door 9 and the main assembly of the printer A reaches a preset value, the projection 9*b* of the door 9 is separated from the actuator 90*a* of the switch 90. As a result, a switch-OFF signal is inputted into the control circuit 100. Receiving this OFF signal, the control circuit 100 determines that the door 9 is opened. Then, the communication control portion of the control circuit 100 begins the process for ending the communication between the control circuit 100 and the storage means 60 of the cartridge B.

Further, as the door 9 is opened, the rod pushing mechanical contact portion 9*c* of the door 9 is moved away from the door contacting portion 55*a*, that is, the front end portion, of the rod 55, eliminating the force which kept the rod 55 pressed in the direction J. As a result, the rod 55 is pushed back (returned) in the direction –J by the resiliency of the spring 56 and 57. However, as the rod 55 is pushed back a short distance, the projection 55*d* of the rod 55 is caught by the downward projection 58*d* of the retaining member 58, and therefore, the rod 55 is prevented from moving further in the returning direction. That is, even after the projection 9*b* of the door 9 becomes separated from the door contacting portion 55*a* of the rod 55, in other words, even after the force which kept the rod 55 pressed in the frame 35 is eliminated, the rod 55 is kept in the same state as that in which the rod 55 was kept when the door was closed. Therefore, it is ensured that the connector 54 and the storage member 60 remains electrically connected.

Figure 17:
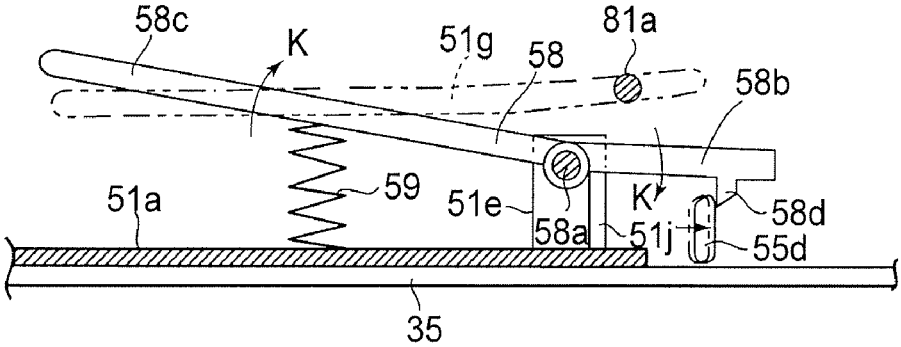
FIG. 17 is a drawing showing the movement (4) of the retaining member.

Further, as the door 9 is opened, the arm 84 is moved in the direction L by the opening movement of the door 9, and therefore, the first linking member 83 is moved in the direction G, causing the lever 82 to rotate about the shaft 82*a* in the clockwise direction M. Thus, the second linking member 81 is moved in the direction N by being pulled by the rotation of the lever 82, causing thereby the projection 81*a* to move rearward along the long slot 51*g*. The distance by which the projection 81*a* is moved rearward along the long slot 51*g* during the initial stage of the opening of the door 9 is minuscule. Thus, the projection 81*a* remains above (remains therefore separated from) the first arm portion 58*b* of the retaining member 58, as shown in FIG. 17, and therefore, it does not interfere with the retaining member 58.

(2-3) Intermediary Stage of Opening of Door 9

Figure 12:
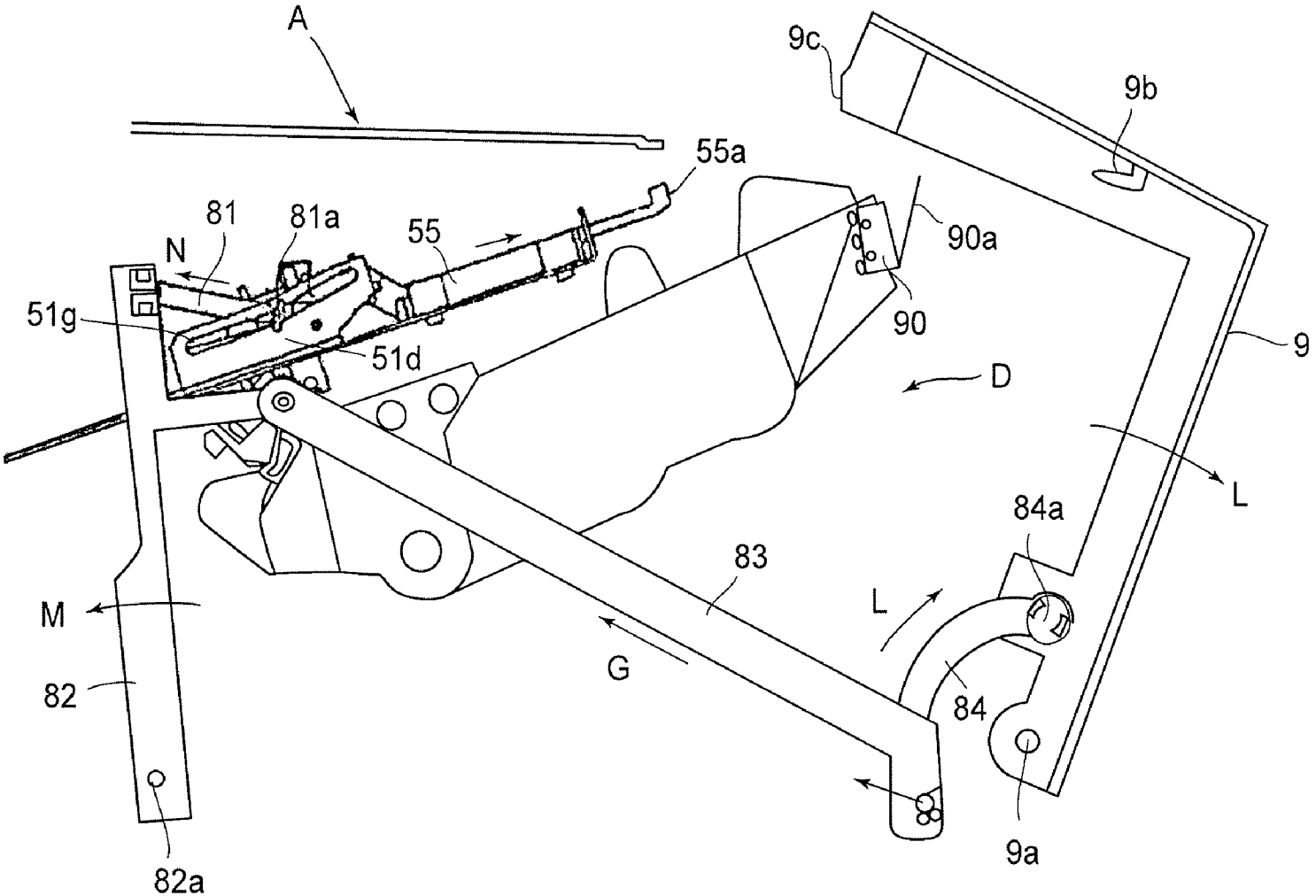
FIG. 12 is a schematic drawing of the image forming apparatus, the door of which is in the mid stage of opening.

FIG. 12 shows the state of the main assembly of the printer A during the mid stage of the opening of the door 9. After the switch 90 turned itself off, the door 9 is to be further opened. As a result, the projection 81*a* of the second linking member 81 is moved further rearward along the long slot 51*g*, by the arm 84, the first linking member 83, the lever 82, and the second linking member 81, which are moved by the opening movement of the door 9.

As the projection 81*a* moves a preset distance, it reaches where the long slot 51*g* intersects with the second arm portion 58*c* of the rod retaining member 58, coming into contact with the top surface of the second arm portion 58*c* (which gradually slopes upward toward rear).

Figure 18:
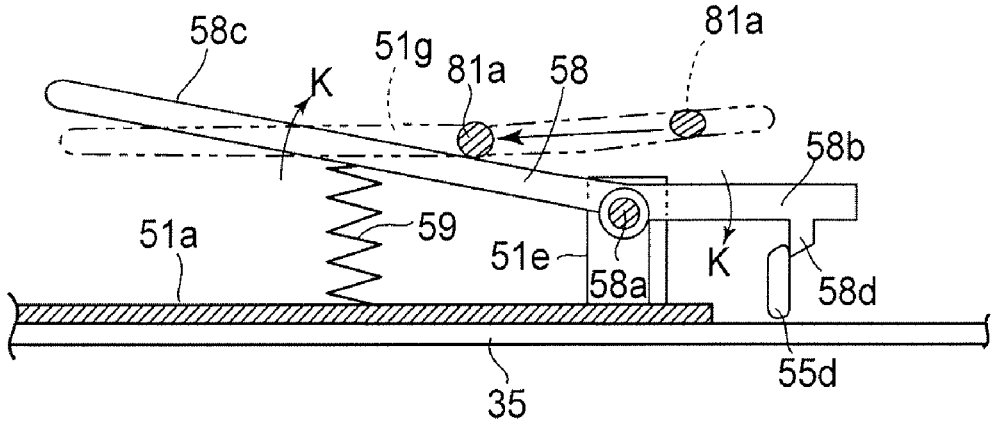
FIG. 18 is a drawing showing the movement (5) of the retaining member.

While the projection 81*a* moves from its location in FIG. 17 to its position in FIG. 18, the projection 81*a* does not contact the retaining member 58 regardless of the opening movement of the door 9; the range between the location of the projection 81*a* in FIG. 17 and the location of the projection 81*a* in the FIG. 18 provides the play.

Figure 19:
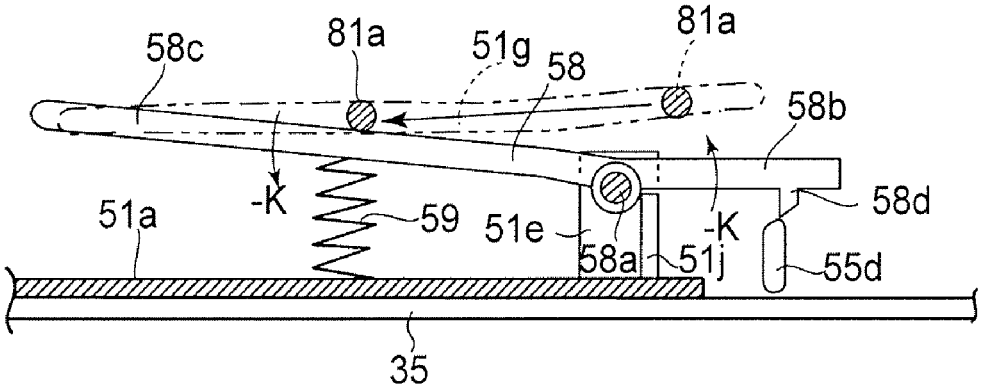
FIG. 19 is a drawing showing the movement (6) of the retaining member.
Figure 20:
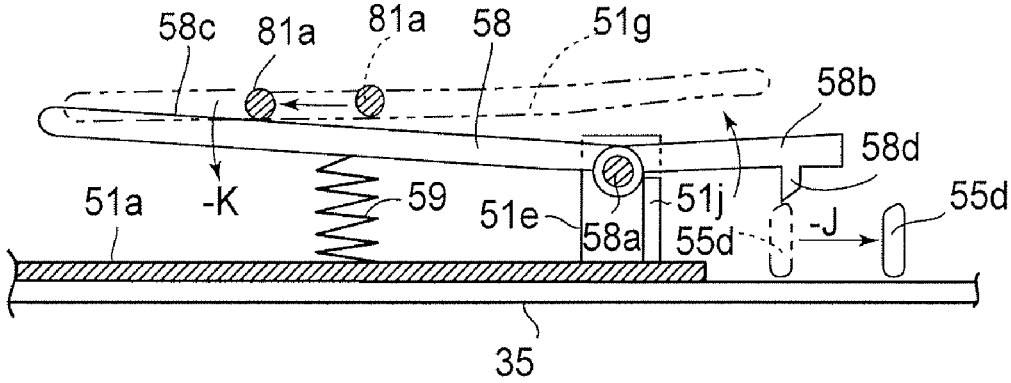
FIG. 20 is a drawing showing the movement (7) of the retaining member.

As the door 9 is further opened, the projection 81*a* is moved further rearward along the long slot 51*g* by the opening movement of the door 9, pressing down on the surface of the second arm portion 58*c* of the retaining member 58. As a result, the retaining member 58 rotates, against the resiliency of the spring 59, about the shaft 58*a* in the direction indicated by the arrow mark –K, causing the downward projection 58*d* to disengage from the projection 55*d*, as shown in FIGS. 19 and 20; in other words, the retaining member 58 disengages from the projection 55*d*, allowing the rod 55 to be returned in the direction –J by the resiliency of the springs 56 and 57.

As a result, the connector supporting member 50 is rotated about the shafts 52*c* in the direction –H in FIGS. 3 and 4, by the pressure applied to the upward arm 52*b* by the resiliency of the first coil spring 56. Therefore, the connector 54 is moved into the retreat position Y, in which it is impossible for the electrical contacts 54*a* and 54*b* to come into contact with the electrical contacts 60*a* and 60*b* of the storage means 60, and is retained in the retreat position Y. That is, the connector supporting member 50 rotates in the direction indicated by the arrow mark –H about the shafts 52*a*, causing the electrical contacts 54*a* and 54*b* to separate from the electrical contacts 60*a* and 60*b* of the storage means 60.

As described above, during the initial stage of the opening of the door 9, it is detected by the switch 90 that the door 9, which was closed, has been opened. However, until the projection 81*a* is moved along the long slot 51*g* by the further opening of the door 9 from the point shown in FIG. 17 to the point shown in FIG. 18, at which the retaining mechanism is disengaged, the connector 54 and the storage means 60 are not disengaged. That is, the connector 54 and the storage means 60 are disengaged from each other as the door 9 is opened by an additional angle after the opening of the door 9 is detected by the switch 90. This period allows the communication control portion of the control circuit 100 to carry out the process for properly completing the communication between the control circuit 100 and the storage means 60 of the cartridge B.

Figure 13:
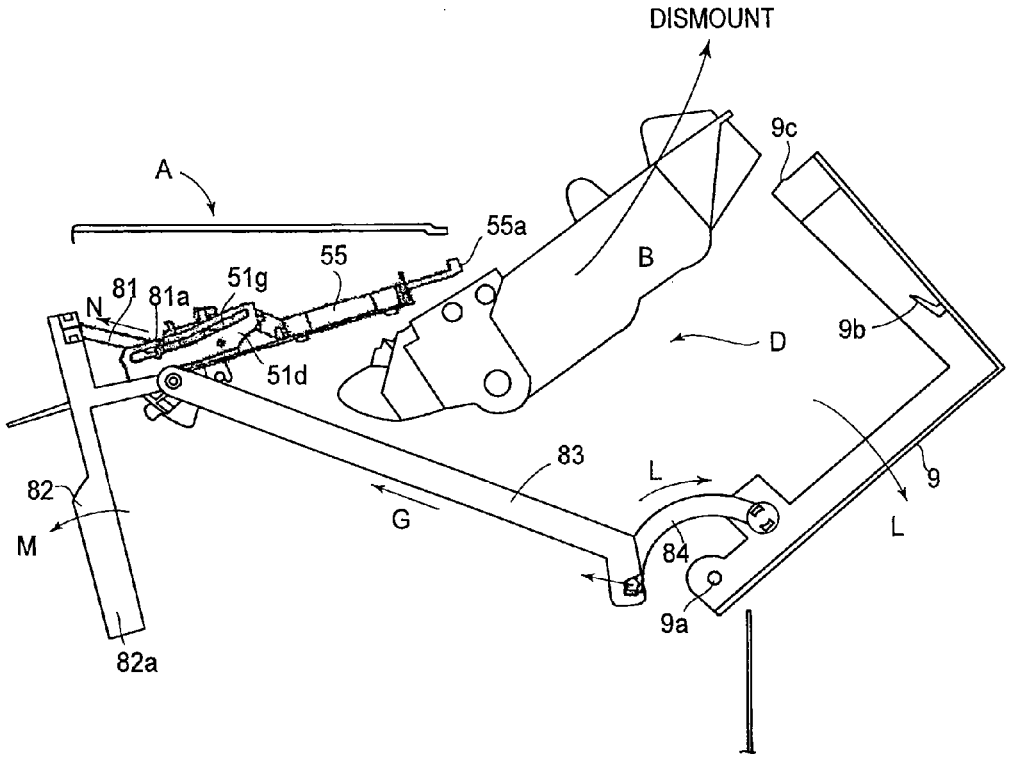
FIG. 13 is a schematic drawing of the image forming apparatus, the door of which is in the mid stage of opening.

(2-4) FIG. 13 shows the main assembly of the printer A, the door 9 of which is fully open. After the separation of the electrical contacts 54*a* and 54*b* of the connector 54 from the electrical contacts 60*a* and 60*b* of the storage means 60, the door 9 is further opened. The opening movement of the door 9 in this time period keeps the arm 84, the first linking member 83, the lever 82, and the second linking member 81 moving, while leaving the connector 50 and the rod 55 retained in the same positions. Then, after the door 9 is opened by a preset angle, which is wide enough for the mounting or dismounting of the cartridge B, a user can pull the cartridge B out of the main assembly of the printer A.

Further, as the door 9, which is fully open as shown in FIG. 13, is closed, the arm 84, the first linking member 83, the lever 82, and the second linking member 81 are moved in the opposite direction from the direction in which they are moved, and therefore, the projection 81*a* of the second linking member 81 moves along the long slot 51*g* to its initial position, shown in FIG. 14, which is on the front side of the long slot 51*g*, and the retaining member 58 rotates back into the attitude shown in FIG. 14. Then, the above described steps shown in FIGS. 15-17 are carried out, restoring finally the above described state, shown in FIG. 10, in which the door 9 is completely shut.

The timing with which the projecting 81*a* of the second linking member 81 comes into contact with the top surface of the second arm portion 58*c* of the retaining member 58 can be easily adjusted by adjusting the angle of the top surface (sloped portion) and/or the angle and range of the long slot 51*g*. That is, the timing with which the electrical contacts 54*a* and 54*b* of the connector 54 are separated from the electrical contacts 60*a* and 60*b* of the storage means 60 during the period from when the door 9 begins to be opened to when the door 9 is completely opened can be easily adjusted.

In the above described embodiment, the connector supporting member 50, the housing 51, the rod 55, the spring 57, etc., constitute the connector moving mechanism which is driven by the closing movement of the door 9 to move the connector 54 into the communication-possible position in which the connector 54 contacts the storage means 60.

The retaining member 58, the rod 55, etc., constitute the retaining mechanism for retaining the connector moving mechanism in the position in which the connector moving mechanism is after the connector moving mechanism moves the connector 54 into the communication-possible position X.

The arm 84, the first linking member 83, the lever 82, the first linking member 81, the projection 81*a*, the long slot 51*g*, etc., constitute the disengaging mechanism for disengaging the abovementioned retaining mechanism. That is, they constitute the disengaging mechanism for disengaging the retaining mechanism to allow the connector 54 to return to the retreat position Y in which the electrical contacts 54*a* and 54*b* of the connector 54 cannot contact the electrical contacts 60*a* and 60*b* of the storage means 60.

In this embodiment, the above described retaining member is made up of the projection 55*d* with which the rod 55 is provided, the projection 58*d* with which the retaining member 58 is provided, the spring 59, etc. However, the retaining mechanism may be structured so that the connector supporting member 50 is directly retained.

According to the above described structural arrangement, when the door 9, which is fully open, is closed, the connector moving mechanism is moved by the movement of the door 9 at a speed proportional to the moving speed of the door 9. However, when the door 9, which is completely closed, is opened, the connector moving mechanism is retained by the retaining mechanism (retaining member), in the position into which it was moved to move the connector 54 into the communication-possible position X, until the door 9 is opened to a preset point. Then, as the door 9 is opened beyond the preset point, the retaining mechanism is activated, allowing the connector moving mechanism to move in the direction to move the connector 54 into the retreat position Y. Therefore, the speed at which the connector moving mechanism operates is set without relying on the opening or closing speed of the door 9. That is, even if the amount of force applied to open or close the door 9 and/or the speed at which the door 9 is opened or closed is substantially varied, the length of time from when the opening of the door 9 is detected by the door switch to when the connector is disengaged from the storage means can be kept longer than a preset value.

In other words, the length of time from when the opening of the door 9 is detected by the door switch to when the connector 54 on the main assembly side of the printer A is disengaged from the storage means 60 on the cartridge B side can be kept sufficiently long to carry out the process for properly completing the communication between the storage means 60 and the control circuit 100 on the main assembly side.

Therefore, it is possible to ensure the reliability of the communication (the process for properly completing communication) between the storage means 60 of the cartridge B and the control circuit on the main assembly side.

Further, until the communication is normally ended, the cartridge B cannot be taken out of the main assembly of the printer A. Therefore, even if an attempt is made to quickly mount or dismount the cartridge B by opening the door 9 at a high speed, the reliability of the communication is kept intact.

With the employment of the above described structural arrangement, the data communication is properly ended by the time the connector is disconnected from the storage means. Therefore, the communication between the storage means and control circuit is reliably carried out.

While the invention has been described with reference to the structures disclosed herein, it is not confined to the details set forth, and this application is intended to cover such modifications or changes as may come within the purposes of the improvements or the scope of the following claims.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 314792/2005 filed Oct. 28, 2005 which is hereby incorporated by reference.

What is claimed is:

1. An electrophotographic image forming apparatus for forming an image on an electrophotographic photosensitive member, said electrophotographic image forming apparatus including a process cartridge which contains said electrophotographic photosensitive member, process means actable on said electrophotographic photosensitive member, a memory that stores information, said memory being provided with a cartridge contact, said electrophotographic image forming apparatus comprising:

(i) an opening configured and positioned to mount and dismount said process cartridge;

(ii) an openable and closable member movable between an opening position for opening said opening and a closing position for closing said opening;

(iii) a detecting member that detects a closing state of said openable and closable member;

(iv) a connector member having a main assembly contact which is movable between a contact position where said main assembly contact contacts said cartridge contact and a separating position where said main assembly contact is separated from said cartridge contact;

(v) an operation member that moves said connector member from the separating position to the contact position;

(vi) a holding member engageable with said operation member to hold said connector member at the contact position;

(vii) a controller that communicates with said memory through said connector member after detection of a change of a signal outputted from said detecting member when said openable and closable member moves away from the closing position;

(viii) a releasing mechanism that releases engagement between said holding member and said operation member after said openable and closable member moves from the closing position toward the opening position by a predetermined distance; and (ix) an urging member that urges said connector member in a direction away from the contact position toward the separating position.

2. An apparatus according to claim 1, wherein said releasing mechanism includes a link member movable in interrelation with movement of said openable and closable member, and wherein said link member is provided with a projection that releases the engagement by contacting said holding member after said openable and closable member moves by the predetermined distance.

3. An apparatus according to claim 2, wherein said projection is movable along a groove provided in the main assembly of said electrophotographic image forming apparatus.

4. An apparatus according to claim 1 or 2, further comprising a second urging member that urges said holding member in a direction of engagement with said operation member.

5. An apparatus according to claim 1, wherein said operation member is pushed by said openable and closeable member to move said connector member from the separating position to the contact position when said openable and closeable member moves from the opening position to the closing position.

6. An apparatus according to claim 1, wherein said openable and closable member is provided with a projection actable on said detecting member.

* * * * *